US005467622A

United States Patent [19]

Becker et al.

[11] Patent Number: 5,467,622

[45] Date of Patent: Nov. 21, 1995

[54] HANDLE LOCK FOR RECIPROCALLY MOVABLE OPERATOR HANDLE

[75] Inventors: James A. Becker, Snellville, Ga.; Ronald J. Fritsch, Menomonee Falls, Wis.; Richard J. Holland, Glendale, Wis.; Robert F. Klobuchar, West Allis, Wis.

[73] Assignee: Eaton Corporation, Cleveland, Ohio

[21] Appl. No.: 236,430

[22] Filed: Apr. 29, 1994

[51] Int. Cl.[6] ..... G05G 5/02

[52] U.S. Cl. ..... 70/203; 70/212; 70/DIG. 63; 70/DIG. 30; 200/43.14; 200/43.15

[58] Field of Search ..... 70/180, 212, 202, 70/203, DIG. 63, DIG. 58, DIG. 30, 18, 14; 200/43.11, 43.14, 43.15

[56] References Cited

U.S. PATENT DOCUMENTS

| | | | |
|---|---|---|---|
| 1,062,525 | 5/1913 | Ward | 33/555.2 |
| 1,383,781 | 7/1921 | Ball | 70/203 |
| 2,198,079 | 4/1940 | Ferris et al. | 292/148 |
| 2,271,475 | 1/1942 | Clade | 70/180 |
| 2,560,624 | 7/1951 | Bartlett | 70/14 |
| 2,707,646 | 5/1955 | Hazy | 292/148 |
| 3,171,908 | 3/1965 | Malota | 200/43.11 |
| 3,291,924 | 12/1966 | Tharp | 200/43.15 |
| 3,312,794 | 4/1967 | Hollyday | 70/212 |
| 3,595,040 | 7/1971 | Carl | 70/203 |
| 3,667,259 | 6/1972 | Reque et al. | 70/14 |
| 4,074,091 | 2/1978 | Bischof et al. | 200/50 A |
| 4,160,137 | 7/1979 | Clement et al. | 200/43.15 |
| 4,260,861 | 4/1981 | DiMarco | 200/42 T |
| 4,467,152 | 8/1984 | Goray | 200/42 T |
| 4,517,747 | 5/1985 | Morin | 33/178 B |
| 4,534,379 | 8/1985 | Burge | 70/180 |
| 4,677,261 | 6/1987 | Nourry | 200/43.15 |
| 4,882,456 | 11/1989 | Hovanic et al. | 200/43.15 |
| 4,978,816 | 12/1990 | Castonguay et al. | 200/43.14 |
| 5,167,135 | 12/1992 | Gobeski | 70/14 |
| 5,349,145 | 9/1994 | Kelaita, Jr. et al. | 200/43.15 |

FOREIGN PATENT DOCUMENTS

| | | | |
|---|---|---|---|
| 6113 | 7/1911 | United Kingdom | 292/148 |

*Primary Examiner*—Barnell M. Boucher
*Attorney, Agent, or Firm*—Larry G. Vande Zande

[57] ABSTRACT

A plate pivotally mounted to a padlock hasp adjacent a reciprocally movable operator handle is pivotable from a stored position to one covering the opening of the hasp, the plate having a hole aligned with the opening and smaller than the opening to receive the shackle of a single, scissors-type safety lockout and maintain the shackle in position to block movement of the operator handle to an operated position. The hole is preferably rectangular to conform to the flat, thin shape of the safety lockout shackle to maintain the shackle properly oriented. An additional round hole for a smaller diameter padlock shackle may be provided in said plate.

15 Claims, 2 Drawing Sheets

HANDLE LOCK FOR RECIPROCALLY MOVABLE OPERATOR HANDLE

BACKGROUND OF THE INVENTION

This invention relates to a handle lock for reciprocally movable handle operated apparatus. More particularly it relates to a handle lock for a reciprocally movable handle of electrical switching apparatus, fluid valve apparatus and the like. Still more particularly this invention relates to padlock provisions for locking the handle in a predetermined operating position and still more particularly, locking the handle in the OFF position.

Manually operated devices such as switches and valves have padlock hasps associated with the operator handle whereby a padlock may be attached through the hasp in a position to block movement of the operator handle from one operating position to an opposite operating position. Thus a workman working on equipment in a line controlled by the apparatus can disconnect electrical or fluid power from the line and be assured that it will not be reconnected until he removes his padlock from the apparatus. The hasps of the apparatus generally will accept up to three padlocks having ⅜ inch diameter shackles to allow individual workmen to apply their respective padlocks.

A device popular with workmen recently is a safety lockout which may be attached to the hasp of the apparatus and itself has provisions to receive up to six padlocks. The safety lockout is a scissors-like device made from a pair of flat hardened steel plates-hinged at approximately the center to provide a pair of openable jaws which close and overlap through the hasp. Handle portions of each plate have six holes which respectively align when the device is closed so that the jaws overlap. Shackles of padlocks may be inserted through any of the aligned six holes to prevent opening of the safety lockout and removal thereof from the apparatus. A problem with the safety lockout is that the flat, two, piece shackle is narrower and thinner than a ⅜ inch diameter padlock shackle. When used in a hasp that can accommodate three ⅜ inch diameter padlock shackles, the safety lockout shackle can be moved and twisted to a position wherein it is ineffective to block the movement of the operator handle.

SUMMARY OF THE INVENTION

This invention provides a handle lock having an improved hasp structure which will accommodate one, two or three ⅜ inch diameter padlock shackles, or a single ¼ inch diameter padlock shackle, or a single safety lockout device, each being fully effective to block movement of the operator handle to an opposite operated position. A plate having a round hole for a single 5/16 inch diameter padlock shackle and an elongated slot for a safety lockout shackle is pivotally attached to the flange defining the hasp and is movable over the hasp opening in the flange to close the opening except for the round single padlock hole and the slot in the plate. The hole and the slot accept a single padlock shackle or the shackle of a safety lockout device respectively, and maintain either in position to fully block movement of the operator handle to an alternate operated position. It is anticipated that this pivoted plate feature can be used directly on a hasp which is integral with the switch or valve apparatus, may be part of an add-on structure which is attached to the switch or valve or to cabinets housing such apparatus, or may be incorporated in an auxiliary operator handle mechanism used with the apparatus.

The invention and its features will become more evident when reading the following description and claims in conjunction with the accompanying drawings.

DETAILED DESCRIPTION OF THE PREFERRED EMBODIMENT

Figure 1:
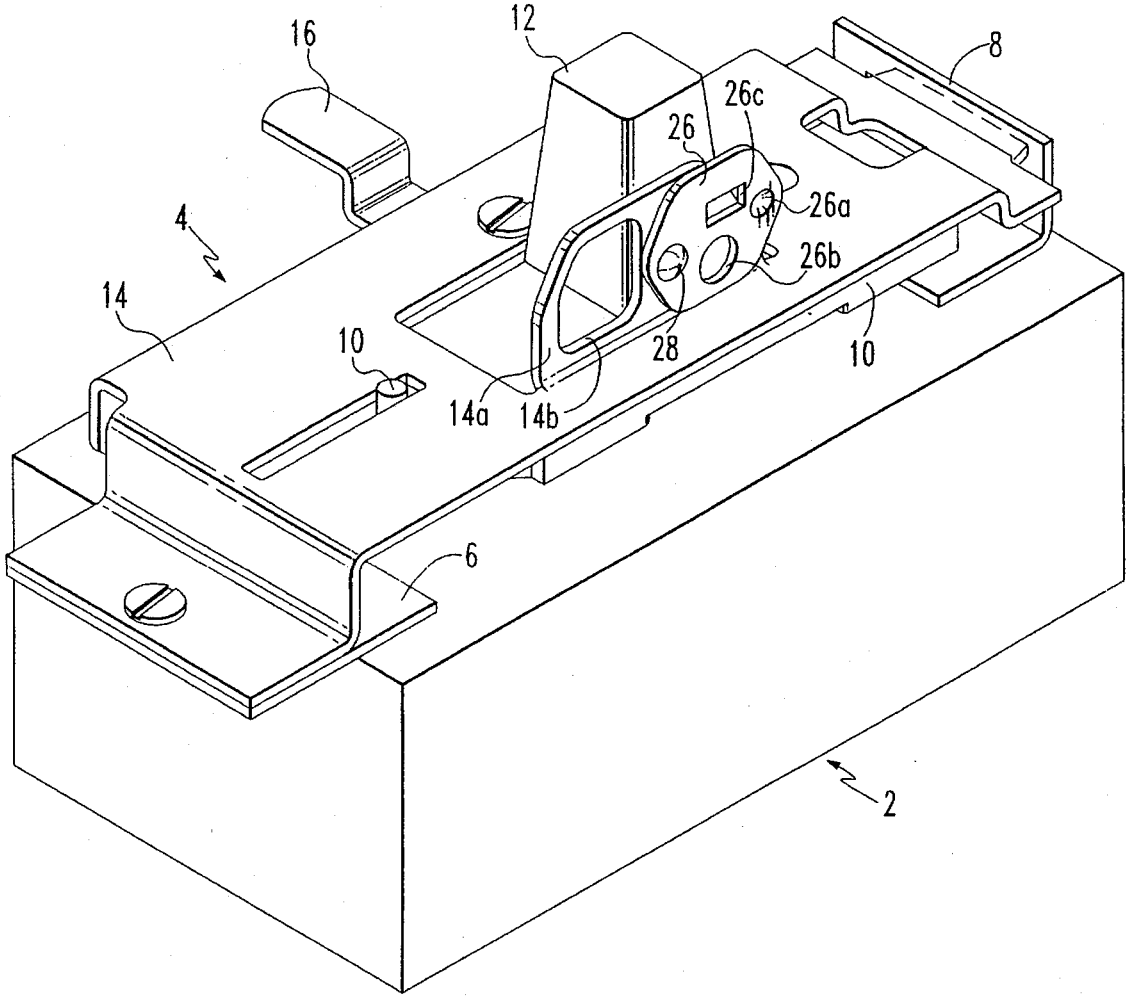
FIG. 1 is a perspective view of a manually operated switching apparatus having an auxiliary switch operator attached thereto, the operator comprising a plate having an upstanding flange providing a hasp for safety devices such as padlocks or safety lockouts to be attached to the apparatus, the pivoted plate of this invention being attached to the flange.

FIG. 1 shows a switching apparatus such as a molded case circuit breaker 2 having an auxiliary operator mechanism 4 attached thereto by brackets 6 and 8 which are affixed to the molded case of the circuit breaker 2. The auxiliary operator mechanism includes a slider to having an operator handle 12 projecting upwardly through a central opening in the frame 14 of the auxiliary operator mechanism. The slider 10 fits over the handle (not shown) of the circuit breaker 2 to provide a larger surface handle operator which also converts pivoted reciprocal motion of the circuit breaker operator handle to linear reciprocal motion of the slider 10. An interlock mechanism 16 is also provided on the auxiliary handle operator mechanism 4 to cooperate with a cabinet door in which the circuit breaker 2 is mounted. A more complete understanding and additional details of the circuit breaker and auxiliary operator mechanism may be found in U.S. Pat. No. 4,074,091 entitled "Interlocking Operating Mechanism for Enclosed Switchgear Having Defeater Interlock" issued Feb. 14, 1978 to J. F. Bischof et al and assigned by mesne assignments to the assignee of this invention, the disclosure of which is hereby incorporated by reference.

Figure 2:
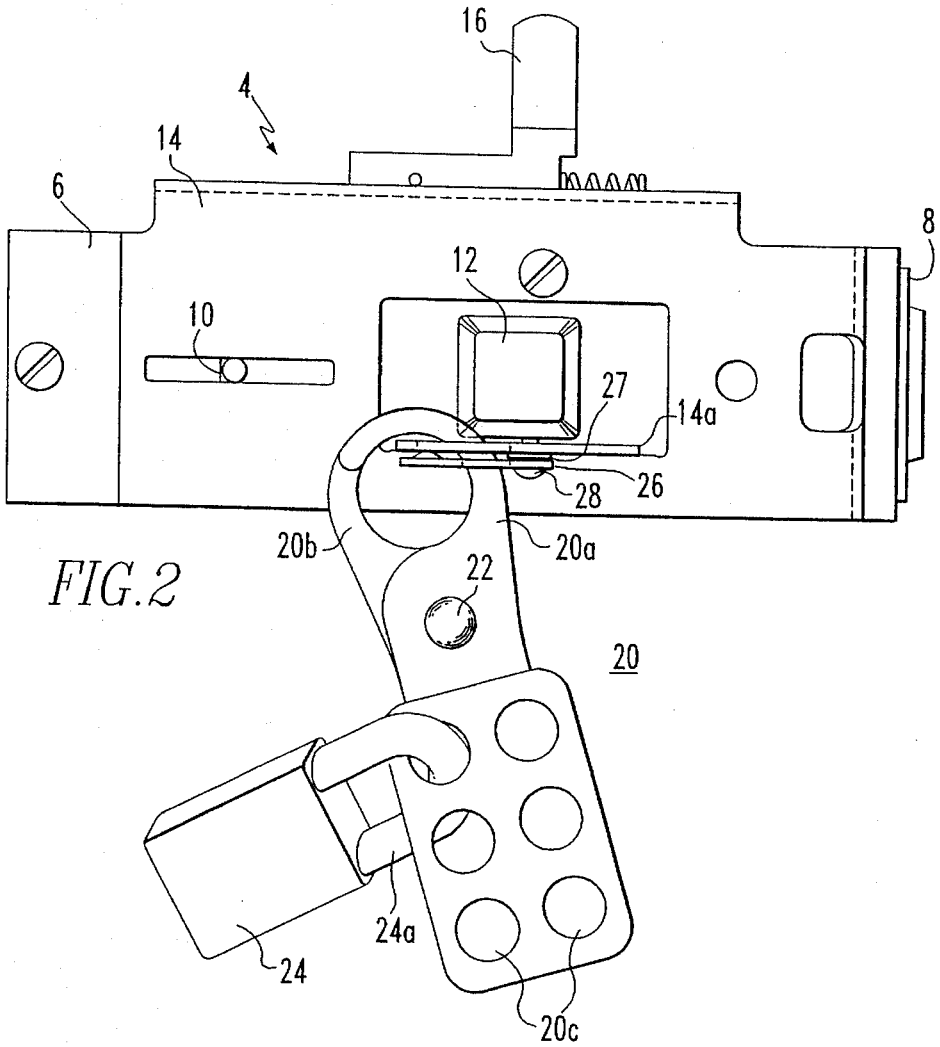
FIG. 2 is a top plan view of the auxiliary operator handle apparatus of FIG. 1 showing a safety lockout device attached thereto.

A security hasp is provided for the handle operator 12 by providing an upstanding flange **14*a* on frame 14 at one side of the opening, the flange 14*a* extending alongside the operator handle 12 generally parallel to the reciprocal movement thereof. Flange 14*a* is provided with an opening 14*b* at one end of the flange. The opening 14*b* is sized and shaped to receive up to three ⅜ inch diameter padlock shackles simultaneously. In a well known manner, locking the padlock to the hasp by inserting the padlock shackle through the opening 14*b* secures the padlock in a position interfering with movement of the operator handle 12, thereby blocking movement of the handle from one operating position to an opposite operating position. In the application of electrical switch gear, the handle is normally blocked from moving from the switch OFF position to the switch ON position and in the case of fluid valving, the handle is usually blocked from moving from the valve closed position to the valve open position. By accepting up to three padlocks, workmen from three different groups or trades can be working on apparatus in the same line at the same time, each with his own padlock secured to the hasp and knowing that the apparatus cannot be operated until his padlock is removed. However, it is becoming increasingly common for more than three workmen to want to place a padlock on apparatus to insure that it is not operated while they are working somewhere in the line, and to this end safety lockout devices 20 (FIG. 3) and 20' (FIG. 4) have been provided which will accommodate up to six padlocks. The safety lockout device is a scissors-like device having a pair of flat members 20***a* and 20*b* pivotally joined intermediate their ends by a rivet 22 or the like. The members 20*a* and 20*b* are hardened steel members having a jaw at the upper end shaped as a portion of a generally circular loop. When joined together and closed, the members 20*a* and 20*b* provide a complete closed-loop shackle. The opposite ends of the members 20*a* and 20*b* are provided with a pattern of six holes 20*c* and 20*d* (seen particularly in FIG. 4 as 20*c*' and 20*d*') which become aligned when the two members 20*a* and 20*b* are pivotally closed. Each of the aligned holes 20*c* and 20*d* can receive the ⅜ inch diameter shackle 24*a* of a padlock 24 as seen in FIG. 2 to prevent opening of the safety lockout device 20. The ends of the elements 20*a* and 20*b* containing the holes 20*c* and 20*d* are customarily insulated with a heavy red vinyl coating that serves also as a warning tag.

It has been found that use of a safety lockout 20 in a padlock hasp designed to accommodate a plurality of padlocks such as 14*b* fails to hold the safety lockout 20 in a position to block handle movement to the ON position. The safety lockout device shackle has a flat, thin cross section as opposed to the round cross section of a padlock shackle. Accordingly, the safety lockout can be twisted or otherwise displaced within the hasp to permit movement of the operator handle 12 to an operated position.

Accordingly, this invention provides an auxiliary plate on the flange 14*a* for reducing the size of the opening of the padlock hasp. Plate 26 is pivotally mounted to the flange by a shouldered rivet 28 and a single-wave spring washer 27 (FIG. 2) disposed over rivet 28 between plate 26 and flange 14*a*. Plate 26 is shown in a stored or inoperative position in FIG. 1 wherein it is disposed adjacent, but to one side of, the opening 14*b*. A dimpled boss 26*a* is provided at one end of the plate 26 wherein the protruding boss portion projects toward the flange 14*a*. The boss portion bears against the surface of flange 14*a* to deflect the plate 26 outwardly against the resilience of washer 27 outwardly whereby the pressure from rivet 28 provides a friction detent of the boss 26*a* against the side surface of flange 14*a*.

Figure 3:
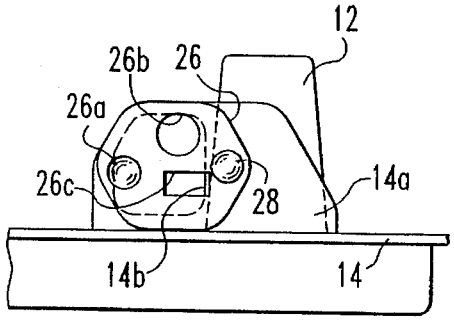
FIG. 3 is a fragmentary view of the operator handle and flange of the mechanism of FIGS. 1 and 2 and showing the plate pivoted into position to restrict the size of the opening in the flange or hasp.

When it is desired to use a safety lockout 20 or a padlock with less than a ⅜ inch diameter shackle to lock the handle operator 12, plate 26 is pivoted about rivet 28 to the position shown in FIG. 3 wherein the plate covers the opening 14*b* in the flange 14*a*. The protruding boss portion 26*a* extends into the opening 14*b* to engage an edge thereof and provide a detent for the plate, resisting movement of the plate back to the stored position. Plate 26 has a round hole 26*b* which aligns near a top edge of opening 14*b* and near an edge of the opening 14*b* which is closest to the operator handle 12 in the OFF position. The size of hole 26*b* will accommodate a shackle less than ⅜ inch diameter of a single padlock. Plate 26 also has an elongated opening 26*c* that is similarly aligned with the opening 14*b*, and overlaps the edge of opening 14*b* closest to the operator handle 12. The rectangular opening will receive the thin flat cross-section section of a shackle of a safety lockout and maintain that shackle properly oriented to block movement of the operator handle 12 to the opposite operated position.

Figure 4:
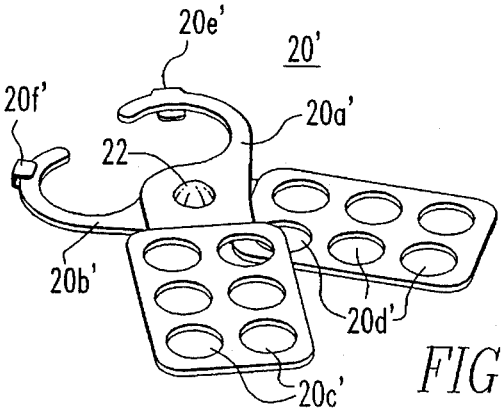
FIG. 4 is a perspective view of an alternate version safety lockout in an open position.

The shackle of safety lockout 20 in FIG. 2 does not have a uniform width, but increases in width closer to the pivot 22. It was discovered that such device could be rotated in elongated opening 26*c* until the wider cross-section wedged within the opening, whereupon the safety lockout 20 could be used as a lever to bend the plate 26 away from flange 14*a*. To prevent this, elongated opening 26*c* extends beyond an edge of opening 14*b* as seen in FIG. 3 whereupon the shackle of safety lockout 20 will wedge against the edge of opening 14*b* in the flange 14*a*. Another version of safety lockout 20' is shown in FIG. 4. This device is made to accept the smaller size padlock shackles. The width of the shackle is uniform over a majority of the shackle, and the jaws are provided with integral U-shaped clips 20*e*' and 20*f*' which each receive the free end of the opposite jaw to prevent forcible separation of the jaws. Such clips also prevent rotation of the shackle within the elongated opening so that the safety lockout may not be used to pry the plate 26 away from flange 14*a*.

The auxiliary operator mechanism 4 described hereinabove is adapted to be used on several different size circuit breakers having different throws for the operator handle to effect operation to the respective ON position. The horizontal location of the hole 26*b* is empirically determined to block movement to the ON position of the handles of each of the breakers when a shackle is positioned through the hole. The security hasp and pivoted plate are intended to lock the circuit breaker operator handle in the OFF position only. A center punch depression (not shown) may be provided on flange 14*a* to the right of rivet 28 as viewed in FIG. 3 to permit the user of the apparatus to drill a hole through the flange to permit the operator handle to be locked in the ON position if so desired.

The foregoing discloses a preferred embodiment and best mode of carrying out the invention which provides a simple, inexpensive solution to a problem. The pivoted plate is easily manufactured and attached to the flange providing a padlock hasp function for an operator handle. It is to be understood that the invention herein disclosed is susceptible to various modifications without departing from the scope of the appended claims.

We claim:

1. A handle lock for a reciprocally movable operator handle, said handle lock comprising:

a flange fixedly disposed proximate said operator handle extending substantially parallel to reciprocal movement of said handle;

an opening in said flange adapted to simultaneously receive a plurality of padlock shackles, a shackle of a single one of said padlocks attached to said flange through said opening being effective for blocking movement of said handle to an operated position;

a plate permanently pivotally mounted to said flange, said plate being movable from a first position alongside said opening to a second position overlying said opening; and at least one hole in said plate aligned with said opening in said second position of said plate, said hole being substantially smaller than said opening and adapted to receive a shackle of a single locking device, said locking device shackle attached to said flange through said opening and said hole, said hole positioning said locking device shackle relative to said opening and said handle for blocking movement of said handle to an operated position.

2. The handle lock defined in claim 1 wherein said hole is located adjacent an edge of said opening closest to said handle in said second position of said plate.

3. The handle lock defined in claim 1 wherein said hole is an elongated opening for receiving a locking device shackle having an elongated cross-section, said elongated opening and said cross-section of said shackle cooperating to maintain said locking device shackle oriented for blocking said movement of said handle.

4. The handle lock defined in claim 3 wherein said elongated opening extends beyond an edge of said opening closest said operating handle in said second position of said plate, said shackle engaging an edge of said opening and an edge of said plate for wedging said shackle firmly against said opening.

5. The handle lock defined in claim 1 wherein said plate comprises said hole and an elongated opening each aligned with said opening in said flange, said elongated opening extending beyond an edge of said opening closest said operating handle in said second position of said plate.

6. The handle lock defined in claim 1 wherein said plate comprises a protrusion from a surface thereof adjacent said flange, said protrusion extending into said opening in said second position of said plate, said protrusion engaging an edge of said opening to provide a detent for said plate, resisting movement of said plate from said second position.

7. The handle lock defined in claim 6 wherein said protrusion engages a surface of said flange in said first position of said plate, deflecting said plate away from said flange and thereby providing a frictional detent for said plate resisting movement of said plate from said first position.

8. The handle lock defined in claim 7 wherein resilient means are disposed between said flange and said plate around said pivot mounting said plate to said flange, said resilient means permitting said deflection of said plate away from said flange.

9. A handle lock for a reciprocally movable operator handle of electrical switching apparatus, said handle lock comprising:

a frame secured to said apparatus;

a flange on said frame disposed alongside said handle;

an opening in said flange, said opening being sufficiently large to simultaneously receive shackles of a plurality of padlocks, a shackle of a single padlock of said plurality of padlocks attached to said flange through said opening being effective for blocking movement of said handle to an ON position of said apparatus;

a plate permanently pivotally mounted to said flange, said plate being movable between a first position alongside said opening and a second position covering said opening; and an elongated opening extending through said plate, said elongated opening being aligned with said opening in said second position of said plate, said elongated opening being substantially smaller than said opening and restricted in size to accept a thin flat shackle of a single safety lockout device attached to said flange through said opening and said elongated opening, said elongated opening positioning said safety lockout shackle relative to said opening and said handle for blocking movement of said handle to said ON position of said apparatus.

10. The handle lock defined in claim 9 wherein said elongated opening extends beyond an edge of said opening closest to said handle in said second position of said plate.

11. The handle lock defined in claim 9 wherein said plate further comprises a hole also aligned with said opening in said second position of said plate, said hole being restricted in size to accept a shackle of a single locking device.

12. The handle lock defined in claim 9 wherein said plate comprises detent means projecting from a surface of said plate adjacent said flange, said detent means extending into said opening and engaging an edge of said opening in said second position of said plate, resisting movement of said plate from said second position.

13. The handle lock defined in claim 9 wherein said plate comprises a boss protruding from a surface adjacent said flange, said boss engaging said flange in said first position of said plate, deflecting said plate away from said flange and providing a frictional detent for said plate, resisting movement of said plate from said first position.

14. The handle lock defined in claim 13 wherein a resilient wave washer is disposed between said flange and said plate around said pivot mounting said plate to said flange, said wave washer permitting said deflection of said plate away from said flange.

15. The handle lock defined in claim 9 wherein said safety lockout device comprises a scissors type device having separable jaws closable to an overlapped condition to provide said lockout device shackle.

* * * * *